US006015051A

United States Patent [19]

Battaglia

[11] Patent Number: 6,015,051

[45] **Date of Patent: *Jan. 18, 2000**

[54] SHELF ASSEMBLY WITH PUSHER HAVING MEMORY CHARACTERISTIC AND METHOD OF USE

[75] Inventor: Joseph M. Battaglia, Douglasville, Ga.

[73] Assignee: L&P Property Management Company, South Gate, Calif.

[ * ] Notice: This patent is subject to a terminal disclaimer.

[21] Appl. No.: 08/919,891

[22] Filed: Aug. 28, 1997

[51] Int. Cl.[7] ..... A47F 1/04; A47F 1/12

[52] U.S. Cl. ..... 211/59.3; 211/51; 312/71

[58] Field of Search ..... 211/59.3, 51, 54.1; 312/71, 61

[56] References Cited

U.S. PATENT DOCUMENTS

| | | | |
|---|---|---|---|
| D. 277,915 | 3/1985 | Field . | |
| 1,229,948 | 6/1917 | Hall . | |
| 1,674,359 | 6/1928 | Frey | 211/51 |
| 1,728,694 | 9/1929 | Morris . | |
| 2,095,649 | 10/1937 | Oswell . | |
| 2,564,518 | 8/1951 | Bedinger . | |
| 2,623,641 | 12/1952 | Shield | 211/59.2 |
| 2,656,233 | 10/1953 | Bollmann . | |
| 2,732,952 | 1/1956 | Skelton . | |
| 2,927,699 | 3/1960 | McGraw . | |
| 2,954,129 | 9/1960 | Gordon | 211/59.3 |
| 3,110,402 | 11/1963 | Mogulescu | 211/59.3 |
| 3,583,724 | 6/1971 | Cowlin . | |
| 3,612,288 | 10/1971 | Lesley . | |
| 4,023,682 | 5/1977 | Niece | 211/184 |
| 4,314,648 | 2/1982 | Spamer . | |
| 4,588,093 | 5/1986 | Field . | |
| 4,600,110 | 7/1986 | Timor | 211/120 |
| 4,742,936 | 5/1988 | Rein | 211/59.3 |
| 4,762,235 | 8/1988 | Howard et al. | 211/59.3 |
| 4,838,436 | 6/1989 | Bailey | 211/51 |
| 5,240,125 | 8/1993 | Kunz | 211/59.3 |
| 5,366,099 | 11/1994 | Schmid | 211/59.3 |
| 5,419,443 | 5/1995 | Niederberger et al. | 211/70.6 |
| 5,449,076 | 9/1995 | Van Noord | 211/59.3 |
| 5,450,969 | 9/1995 | Johnson et al. . | |
| 5,614,288 | 3/1997 | Bustos . | |
| 5,641,077 | 6/1997 | Tufano et al. | 211/54.1 |
| 5,665,304 | 9/1997 | Heinen et al. | 211/59.3 X |

*Primary Examiner*—Daniel P. Stodola
*Assistant Examiner*—Gregory J. Strimbu
*Attorney, Agent, or Firm*—Wood, Herron & Evans, L.L.P.

[57] ABSTRACT

A shelf assembly comprising a shelf having a front frame member and a rear frame member and a plurality of substantially parallel dividers extending between the front frame member and the rear frame member. The dividers are arranged in pairs defining a plurality of tracks for supporting a plurality of products arranged in columns between the pairs of dividers. At least one pusher is located within each track for urging a column of products forwardly along the track. Each pusher comprises a sheet of flexible material having a memory characteristic which biases the sheet toward a flat planar orientation. Each pusher is forced into an upwardly bowed inverted U-shaped configuration between the rear frame member of the shelf and a rearwardmost product in a column of products in a track so as to urge the column of products forwardly toward the front frame member when a forwardmost product is removed.

39 Claims, 3 Drawing Sheets

SHELF ASSEMBLY WITH PUSHER HAVING MEMORY CHARACTERISTIC AND METHOD OF USE

FIELD OF THE INVENTION

This invention relates to a self-feeding shelf assembly and, more particularly, to a gravity feed shelf assembly in which there is a pusher for pushing a column of product arranged on a shelf of the assembly forwardly to locate a forwardmost object in the column at the front of the shelf.

BACKGROUND OF THE INVENTION

Merchants commonly display their products in shelved structures. Often such shelved structures have a plurality of shelves, each shelf having a plurality of dividers dividing the shelf into a plurality of tracks extending from the back of the shelf forwardly. Product being displayed is arranged in columns on the shelf, the columns being located within the tracks. These tracks enable the merchant to separate items for purposes of maximizing the number of objects or items being displayed or to enable different items in different tracks to be displayed in order to enable a consumer to easily differentiate between products. Typically, a consumer grabs the forwardmost product in a column. If the shelf is horizontally oriented, the products behind the forwardmost product in a track may remain in essentially the same position once the forwardmost product has been removed such that a second consumer must reach further back in the display to grasp the closest available product within the track. As more products are removed from the track, customers must reach further back inside the track to grasp a product.

In order to provide a continuous supply of product at the front of the tracks of shelves of a display rack shelf, shelves have been declined such that the front of the shelves are located below the rear of the shelves. Gravity then forces the product to the forward edge of such shelves where it is easily accessible to customers. The angle of the shelf determines the amount of force gravity will have on the product so that the product moves forward. Often plastic slip surfaces, such as that disclosed in U.S. Pat. No. 5,614,288, are placed on such shelves providing a slip surface enabling the products to more easily slide forwardly to the front of the declined shelf. The plastic used to make such slip surfaces may be impregnated with silicone in order to increase the slipperiness of the plastic so that products may more easily slide down the slip surface to the front of the shelf. Even without a declined shelf, a plastic slip surface may aid in the delivery of products to the front of the shelf.

Several patents have disclosed devices which have attempted to move product forwardly on a horizontal shelf. U.S. Pat. No. 2,732,952 discloses a shelf attachment which comprises two plates hinged together at the top of the plates. A spring urges the two plates apart from one another such that when the shelf attachment is placed between a vertical wall and product on a horizontal shelf, the spring causes the plates to separate urging the product forwardly on the shelf. The rear plate is attached to the vertical wall with screws and the forwardmost plate has a strip upon which the rearwardmost products on the shelf rest. Although this patent does disclose a device for urging products forwardly on a horizontal shelf, the springs used in the device are subject to wear and tear and may deteriorate over time causing the device to not function properly. Further, such a device must be secured to a vertical wall at the back of the shelf with screws and without such a vertical wall, the device will not function correctly.

Similarly, U.S. Pat. No. 5,450,969 discloses a device for use on a horizontal shelf for urging products forwardly on the shelf. The shelf is divided into tracks by dividers and a backing plate urges a row of products forwardly within each track. Each backing plate is urged forwardly by a coiled spring located behind the backing plate, the coiled spring being secured at the front of the track. The spring is coiled behind the backing plate such that when the forwardmost product within a track is removed, the backing plate pushes the row of products forwardly in the track by the force of the spring pushing on the rear of the backing plate. Again, this device utilizes a spring which is subject to wear over time. In addition, the backing plate rides within a groove in the shelf bottom and may become stuck in the groove causing the backing plate to not move forwardly.

Another patent which discloses a merchandise display device in which there is a pusher positioned at the rear of a display case or drawer for pushing product forwardly in the display case or drawer is U.S. Pat. No. 4,588,093. In this patent, the pusher is in the form of an accordion-like expansible member which includes plural steel spring biasing clips positioned at each of the apexes of the accordion.

Therefore, it has been one objective of the present invention to provide an inexpensive pushing mechanism for urging a column of products forwardly inside a track on a shelf which is not subject to wear over time and does not deteriorate with repeated use.

It further has been an objective of the present invention to provide a mechanism for urging columns of products forwardly in tracks on a shelf which does not need to be secured to a vertical wall behind the shelves.

Further, it has been an objective of the present invention to provide a pusher mechanism for urging products forwardly on a shelf which may be quickly and inexpensively added to a back of a shelf and which may be easily moved from track to track on a shelf.

SUMMARY OF THE INVENTION

The invention of this application which accomplishes these objectives comprises a shelf assembly comprising a shelf and at least one pusher for urging products forwardly on the shelf. A shelf support supports the shelf and may comprise four vertical posts secured to a base, a vertical wall or any other supporting structure. The shelf comprises a shelf frame comprising a front frame member and a rear frame member, the rear frame member being secured to the shelf support. The shelf further comprises a plurality of substantially parallel, spaced dividers extending between the front frame member and the rear frame member, the dividers being arranged in pairs. Each pair of adjacent dividers defines a track for supporting a plurality of products arranged in a column between the pairs of dividers.

At least one pusher is located in a track for urging the column of products forwardly along the track toward the front frame member. Each pusher comprises a sheet of flexible material having a memory characteristic or property which biases the sheet of material toward a flat planar orientation. The pusher is forced into an upwardly bowed inverted U-shaped configuration between the rear frame member and a rearwardmost product in the column of products in the track so as to urge the column of products forwardly toward the front frame member. Each pusher has two pair of opposed recesses adapted to receive the dividers so that the sheet of material may slide along the dividers without becoming separated from the dividers upon the removal of one or more products within the track.

Each of the dividers has a vertical portion and a horizontal portion, the vertical portion extending upwardly from the horizontal portion. The endmost dividers have an L-shaped cross section and the remainder of the dividers have an inverted T-shaped cross section. Silicone extrusions may be inserted onto the horizontal portions of the dividers so as to enable the pushers and product to more easily slide along the tracks of the shelf.

A sled adapted to slide within a track defined by a pair of dividers may be utilized to support the rearwardmost product within a column of products. The sled may be constructed of wire or any other material and has means in the form of guide members to loosely hold the sled to a pair of dividers such that the sled may slide within a track. A pusher is forced into an upwardly bowed inverted U-shaped configuration between the rear frame member and the sled and the inherent characteristics of the pusher push the sled holding the rearwardmost product forwardly upon the removal of one or more products from the track by a consumer. Thus, a consumer may remove one or more products within a track and the pusher will push products forwardly within the track in which product has been removed so that the next customer may find product located at the front of the shelf rather than having to reach inwardly to obtain a product.

The pusher of the present invention need not be permanently secured to the shelf assembly and may simply be removed by rotating the pusher slightly causing the recesses of the sheet to separate from the horizontal portions of the dividers. Thus, pushers may be easily exchanged and relocated from track to track. These and other objects and advantages of the invention of this application will become more readily apparent from the following description of the drawings.

DETAILED DESCRIPTION OF THE DRAWINGS

Figure 1:
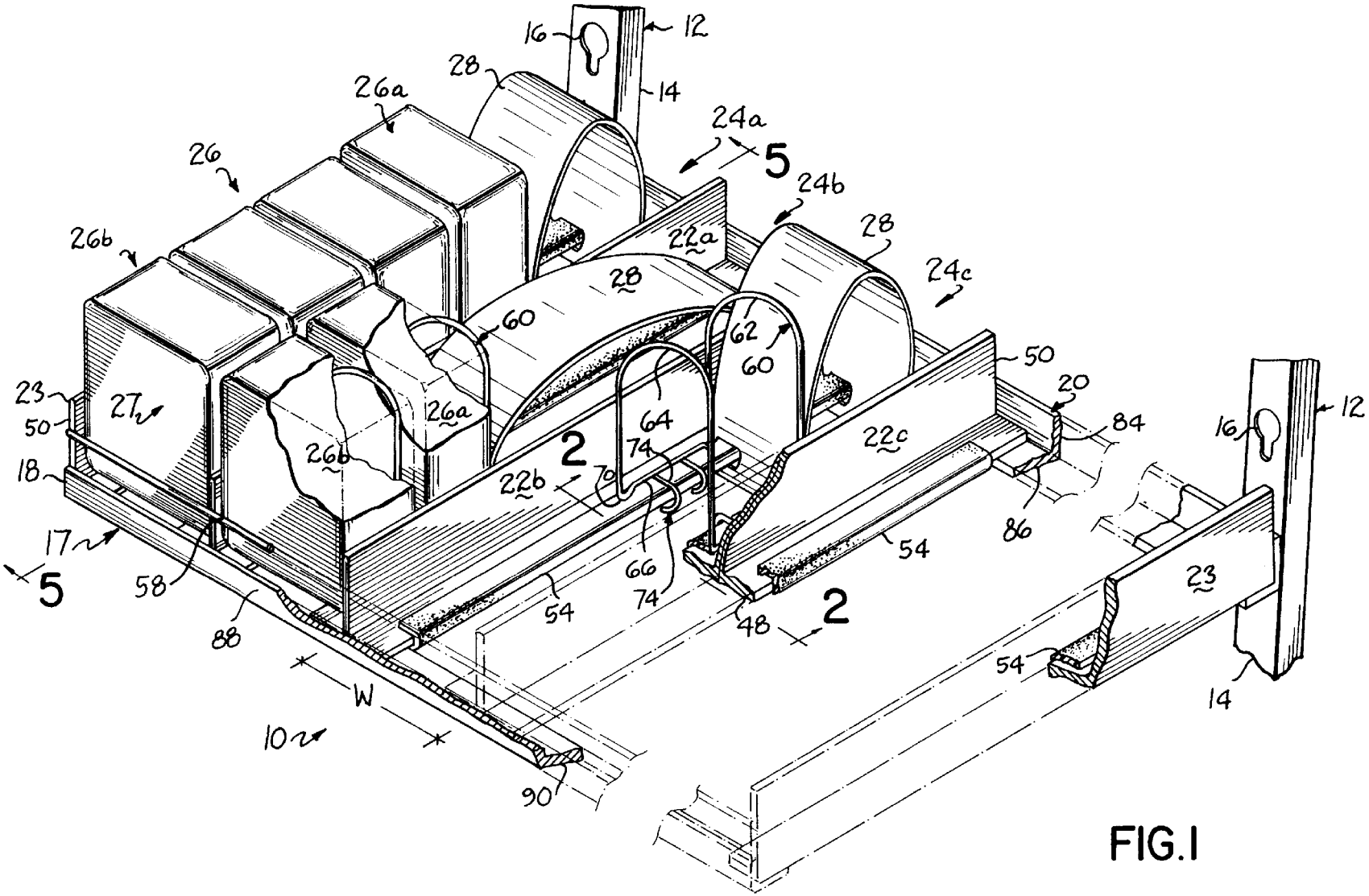
FIG. 1 is a perspective view partially broken away of the shelf assembly of the present invention.

Referring to the drawings, and particularly to FIG. 1, there is illustrated a shelf assembly 10 including a shelf support 12. The shelf support 12 may take any number of forms such as gondola racks or four poster racks. For purposes of illustration, the invention is illustrated as applied to a rack having four vertical posts 14 two of which are illustrated in FIG. 1. As there illustrated, the posts 14 have a plurality of spaced key shaped holes 16 therein to aid in securing a shelf 17 to the shelf support 12 but the shelf 17 may be secured to the shelf support 12 in any known manner.

The shelf 17 comprises a front frame member 18 spaced forwardly of a rear frame member 20. The rear frame member 20 may be secured to the shelf support 12 in any known manner, including but not limited to projections (not shown), extending from the rear frame member 20 into the holes or slots 16 of the vertical posts 14 of the shelf support 12.

A plurality of substantially parallel spaced internal dividers 22 and two endmost dividers 23 extend between the front frame member 18 and the rear frame member 20. The dividers 22, 23 are arranged in pairs, each pair of adjacent dividers defining a track 24 of a width W equal to the distance between a pair of adjacent dividers (see FIG. 1). A shelf 17 may have any number of tracks 24 depending on the number of dividers 22 extending between the front frame member 18 and the rear frame member 20. A plurality of products 26 are arranged in linear columns 27 within the tracks 24 and are supported by the dividers 22, 23. The products 26 may be packages of material such as coffee, boxes of crackers or any other item. The width of the products is essentially the same as the distance between dividers or the width of the tracks. Tracks 24 may be of differing widths so that different products 26 may be located in adjacent tracks 24. Referring to FIG. 1, and, more particularly, to the left of the break in the shelf illustrated in FIG. 1, an endmost divider 23 and three internal dividers 22*a–c* are illustrated so as to define three adjacent tracks 24*a, b* and *c*.

As best illustrated in FIG. 1, each divider has a horizontal portion 48 and a vertical portion 50 projecting upwardly from the horizontal portion 48. The endmost dividers 23 have an L-shaped cross section and the interior dividers 22 between the endmost dividers 23 have an inverted T shaped cross section. The endmost dividers 23 are welded or otherwise fixedly secured to the front frame member 18 and the rear frame member 20 in order to create a generally rectangular frame. The interior dividers 22 may or may not be secured to the front and rear frame members 18, 20. If not secured to the front and rear frame members 18, 20, the interior dividers 22 may be laterally movable but are supported by the front and rear frame members 18, 20 in order to adjust for products of differing widths.

The rear frame member 20 is illustrated as having a substantially L-shaped cross section comprising a vertical member 84 and a horizontal member 86 extending forwardly from the lower edge of the vertical member 84. The vertical member 84 functions as a stop preventing the dividers 22 from moving rearwardly and falling off the shelf 17. The horizontal member 86 provides a resting surface for the dividers 22. Likewise, the front frame member 18 comprises a vertical member 88 and a horizontal member 90 extending inwardly from the vertical member 88 such that the front frame member 18 has an L-shaped cross section. The vertical member 88 prevents the dividers 22 from falling off the front edge of the shelf 17. Although the rear frame member 20 and the front frame member 18 are illustrated as having L-shaped cross sections, they may take other forms as well.

Figure 4:
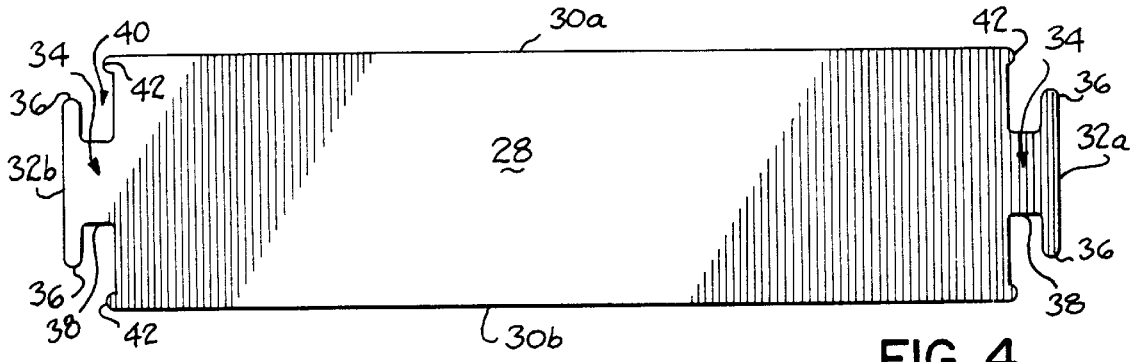
FIG. 4 is a top plan view of a pusher utilized in accordance with the present invention.

At least one pusher 28 may be located within a track 24 and is used to urge a column 27 of products 26 forwardly within the track. As illustrated in FIG. 4, pusher 28 comprises a sheet of flexible material having a memory characteristic which biases the sheet toward a flat planar orientation. In use, the pusher 28 is forced into an upwardly bowed inverted U-shaped configuration between the rear frame member 20 and a rearwardmost product 26*a* in a column 27 of products 26 (see track 24*a*). Thus, the pusher 28 urges a column 27 of products 26 forwardly toward the front frame member 18 when the forwardmost product 26*b* in the column is removed. As more products 26 are removed from the column 27, the pusher 28 moves forwardly with the column of products. The height of the inverted U-shaped pusher 28 decreases as the pusher 28 moves toward the front frame member 18 urging products 26 in that same direction (compare FIGS. 5 and 6).

Referring again to FIG. 4, at rest the pusher 28 is in a generally planar orientation having two opposed side edges 30*a* and 30*b* and two end edges 32*a* and 32*b*. At each end of the pusher 28 is a T section 34 comprising two tabs 36 and a throat 38. Outside of the throat 38 are two recesses 40 such that each pusher has four recesses 40, two adjacent each end of the pusher. Extending into each recess from a body of the pusher, there is a dimple 42.

Figure 2:
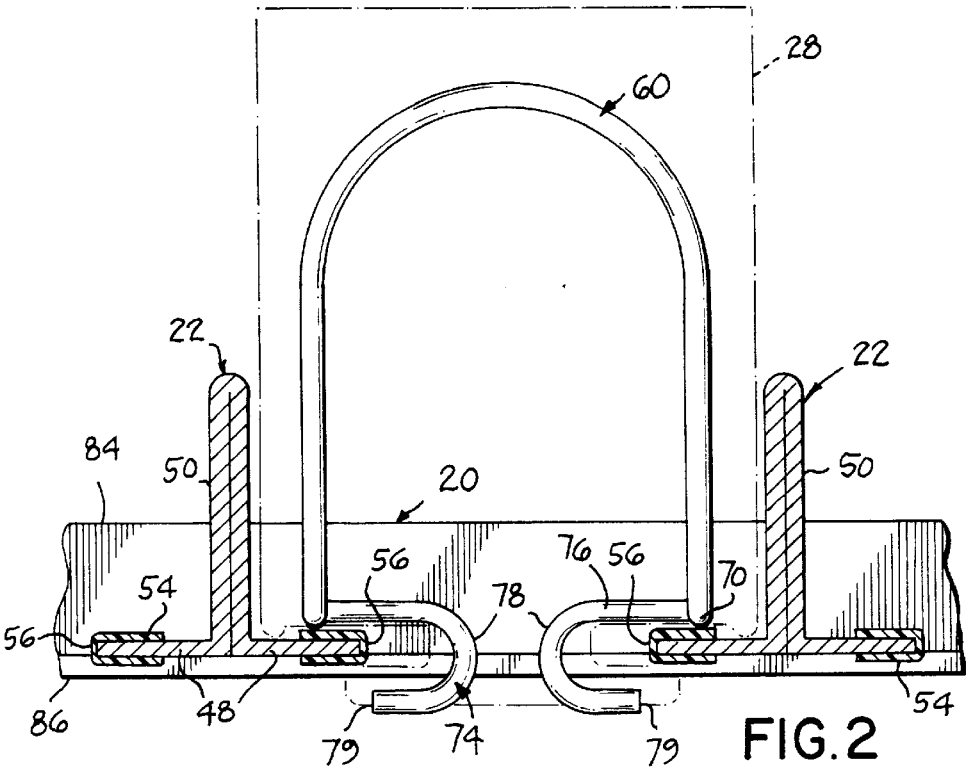
FIG. 2 is a cross-sectional view taken along the lines 2—2 of FIG. 1.
Figure 7:
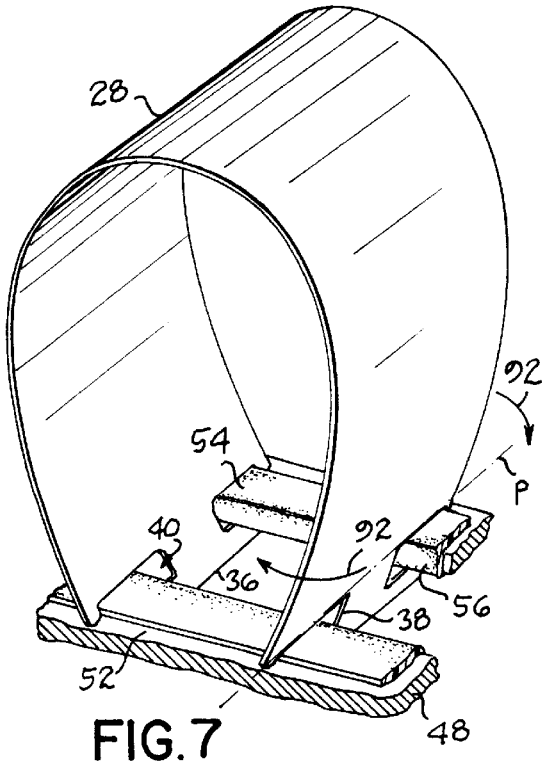
FIG. 7 is a perspective view of a pusher slidably secured in a track between a pair of dividers.

As illustrated in FIGS. 2 and 7, the recesses 40 of the pusher 28 are adapted to engage the horizontal portions 48 of adjacent dividers 22, 23 and enable the pusher 28 to move inside a track 24. The horizontal portions 48 of the dividers 22, 23 are generally co-planar and form a substantially planar supporting surface 52 on which the products 26 rest. The tabs 36 of the T sections 34 of the pushers 28 are located substantially below the supporting surface 52 as illustrated in FIG. 7 with the throat 38 being substantially in the plane P of the supporting surface 52. The dimples 42 of the pusher 28 rest on the horizontal portions 48 of the dividers and provide a relatively small area of contact between the horizontal portions 48 of the dividers and the pusher 28, thus enabling the pusher 28 to more easily slide inside a track 24.

Plastic silicone containing extrusions 54 which have a substantially U shaped cross section may be slipped over the horizontal portions 48 of the dividers to decrease the coefficient of friction of the horizontal portions of the dividers and increase the ability of product 26 and a pusher 28 to move along a track 24. The silicone containing plastic extrusions 54 may be permanently secured to the horizontal portions 48 of the dividers or may be snap fit into place such that they are easily removable. So positioned, the extrusions 54 cover and provide a low friction slip surface for the horizontal portions 48 of the L shaped endmost dividers 23 and the horizontal portions 48 of the inverted T shaped interior dividers 22 as well as the vertical side edges 56 thereof.

As best illustrated in FIG. 1, a stopper 58 may be located at the front end of each track 24 in order to prevent the products 26 from falling off the shelf 17. The stopper 58 may consist of a wire as illustrated in FIG. 1 extending all the way across the width of the shelf 17 and be secured to the vertical portions 50 of the interior dividers 22. Alternatively, the stopper 58 may consist of an inverted U-shaped piece of wire (not shown) secured to the front frame member 18 at the front end of each track 24 in order to prevent products from falling off the shelf 17.

The pusher 28 may be made of numerous sheet materials such as sheet plastic or sheet steel. One type of plastic sheet material which has been used successfully is made from an amorphous glycol modified polyethylene terephthalate (PETG), commercially available from Eastman Chemical Company. PETG is a polyester prepared by the reaction of cyclohexanedimethanol and ethylene glycol with terephthalic acid. Polyethylene terephthalate film is generally characterized by a relatively high resistance to failure on repeated flexing, and has high tensile strength and low moisture absorption. Products made of polyethylene terephthalate have high impact strength and are able to withstand multiple flexions. Though PETG has been successfully used to make a pusher 28, this application does not intend to limit the composition of the pusher to one specific material such as PETG. The pusher 28 may be made of any number of different plastics having acceptable flexion properties, including but not limited to polyesters of which polyethylene terephthalate is one.

Figure 3:
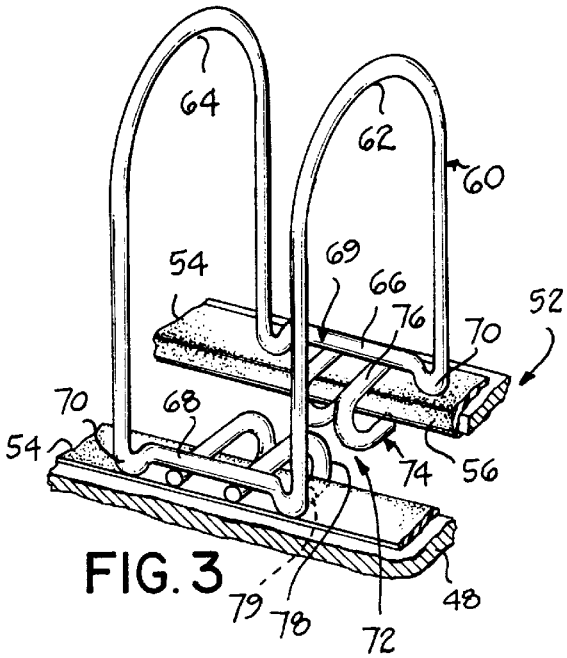
FIG. 3 is a perspective view of the sled of FIG. 2.

As best illustrated in FIGS. 2 and 3, a sled 60 may be used to transport the last or rearwardmost product 26*a* in a column of products in accordance with the present invention. The sled 60 may take any one of numerous forms, one of which is illustrated in FIGS. 2 and 3. In addition, the sled 60 may be made of several different materials. The sled illustrated in the drawings is made of wire and comprises an inverted U-shaped back portion 62 and an inverted U-shaped front portion 64. The front and back portions 62, 64 are generally parallel and connected by two connecting portions 66 and 68 extending substantially parallel the dividers. Each of the connecting portions 66, 68 has a central recessed portion 69 formed between two end sections 70. A pair 72 of guide members 74 on one side are welded or otherwise secured to the central recessed portion of each connection portion 66, 68. These guide members 74 extend inwardly from each connection portion 66, 68 and are adapted to engage a horizontal portion 48 of a divider. Each guide member 74 comprises a substantially straight segment 76 and a downwardly extending hook segment 78 terminating in an end 79 (see FIG. 2). The sled 60 is adapted to ride inside one of the tracks 24 and support a rearwardmost product 26*a* within a column 27 of products. As best illustrated in FIG. 2, the distance between the ends 79 of hook segments 78 may be equal to or slightly greater than the distance between the opposed side edges 56 of the horizontal portions 48 of a pair of dividers 22, 23 such that the sled 60 may easily slide up and down the track 24 without becoming removed from the dividers while being pushed forwardly by the pusher 28.

Figure 5:
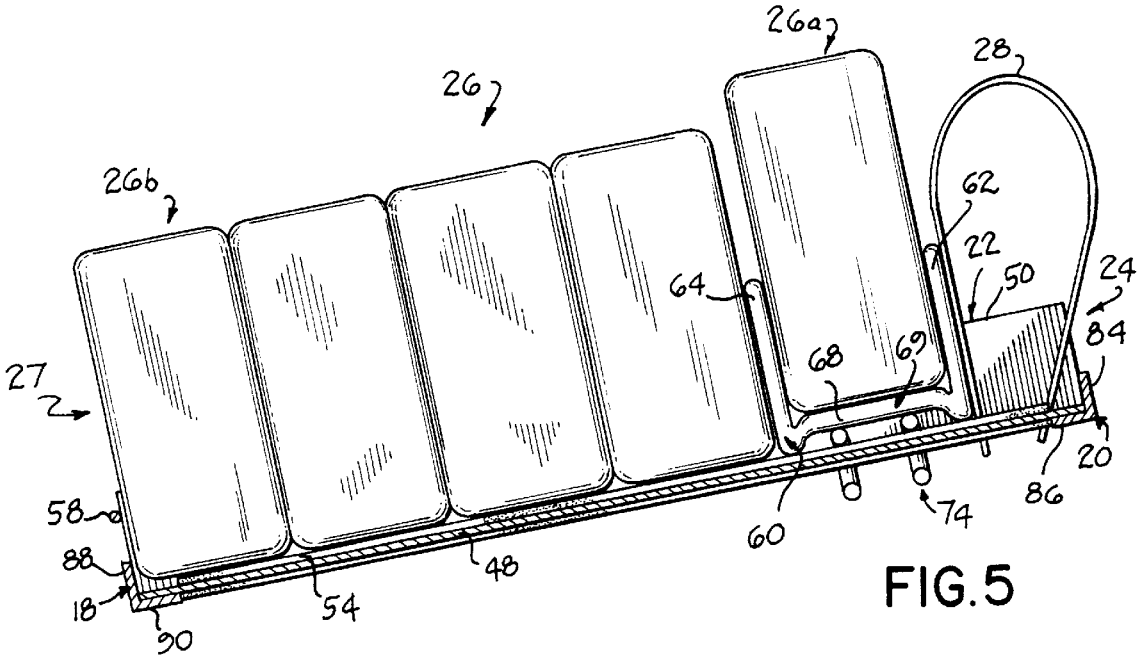
FIG. 5 is a cross sectional view of one track having a plurality of products therein, the rearwardmost product being located within a sled and being urged forwardly by a pusher.
Figure 6:
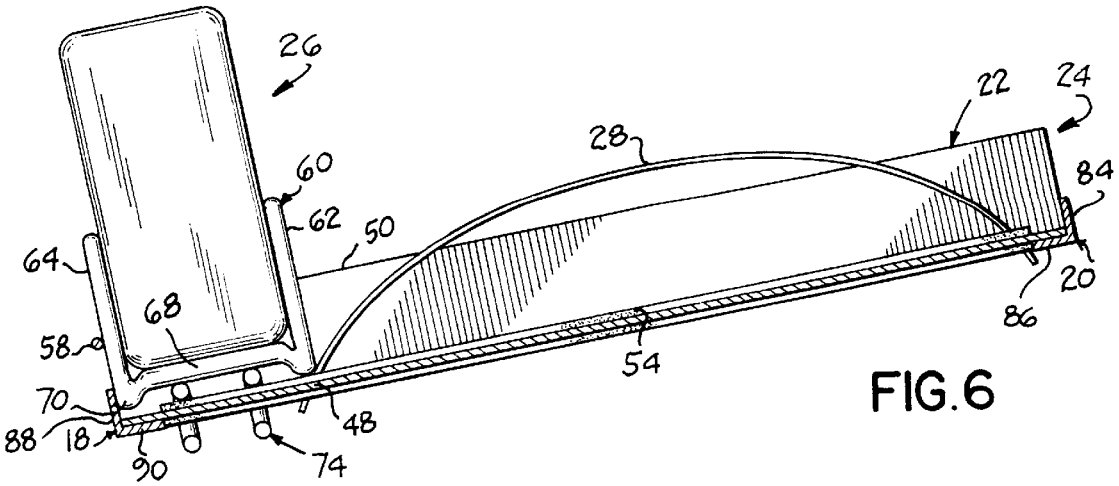
FIG. 6 is a cross sectional view of the track of FIG. 5 with all products removed except for the rearwardmost product located in a sled, the pusher being expanded towards its planar orientation from its more bowed orientation of FIG. 5.

Referring to FIGS. 5 and 6, when a track 24 is full of product 26 and a pusher 28 is forced into an inverted U-shaped configuration, the pusher 28 abuts the rear frame member 20 and the back portion 62 of the sled 60 urging the sled 60 forwardly in the track. As products are removed from the front of a column, the sled 60 is urged forwardly pushing the products ahead of the sled 60 in the track forwardly toward the front frame member 18 of the shelf. When all the products, except for the rearwardmost product 26*a*, are removed from the track, the pusher is in an extended position as illustrated in FIG. 6 but still is slightly upwardly bowed and abuts the rear frame portion 20 and the back member 62 of the sled 60.

Although FIG. 1 illustrates a generally horizontal shelf with the front and rear frame members 18, 20 being substantially co-planar, the pusher of the present invention may be utilized on declined shelves as well as horizontal shelves. FIGS. 5 and 6 illustrate a declined shelf in which the rear frame member 20 is located above the front frame member 18 so that gravity aids in forcing the products toward the front frame member 18. The steeper the shelf decline, the greater the force gravity exerts on the products and the less force the pusher 28 must exert on the sled 60 in order to urge a column of products within a track forwardly toward the front frame member 18.

As illustrated in FIG. 7, by rotating the pusher slightly in the direction of arrows 92, the tabs 36 of a T section 34 at one end of the pusher 28 may come out from underneath the supporting surface 52 defined by the horizontal portions 48 of the dividers 22 such that the pusher 28 may be removed from the shelf. In this fashion, pushers may be easily moved from one track to another or removed fully from the assembly when all the products within a track have been removed. The pusher 28 of the present invention provides a device for urging products forwardly in tracks on a shelf without the use of any springs or any multiple piece device. Instead, the pusher comprises simply a relatively low cost sheet of material having a memory characteristic tending to urge the pusher into a flat planar orientation. Thus, the pusher of the present invention is less expensive to manufacture and easier to install and use than heretofore known pushers.

Although a detailed description of a single preferred embodiment of the present invention has been described above, it will be readily appreciated by those of ordinary skill in the art that many modifications may be made without departing from the spirit and scope of the present invention. It is therefore applicant's intention to be bound only by the scope of the claims and not to the detailed specifics provided in the specification above.

I claim:

1. A shelf assembly comprising:

a shelf frame having a front frame member and a rear frame member and a plurality of substantially parallel spaced dividers extending between said front frame member and said rear frame member, each of said dividers having a horizontal portion and a vertical portion, the horizontal portions of the dividers defining substantially planar supporting surfaces, an adjacent pair of said dividers defining a track for supporting a plurality of products arranged in a column between said pair of adjacent dividers; and a pusher for urging said column of products forwardly along said track, said pusher comprising a sheet of material having a memory characteristic, said pusher having a plurality of recesses, said horizontal portions of said pair of adjacent dividers being received inside said recesses of said pusher so as to retain and guide said pusher in said track, said pusher being adapted to assume an upwardly bowed inverted U-shaped configuration above said supporting surfaces between said rear frame member and a rearwardmost one of said products in said track upon receipt of said column of products such that said memory characteristic biases said sheet toward a flat planar orientation so as to urge said column of products toward said front frame member.

2. The shelf assembly of claim 1 wherein a pair of said recesses engage a respective one of said pair of adjacent dividers.

3. The shelf assembly of claim 2 wherein said horizontal portions of said pair of adjacent dividers are located partially within said recesses such that said pusher is adapted to partially flatten upon removal of a forwardmost one of said products without said pusher separating from said pair of adjacent dividers.

4. The shelf assembly of claim 1 wherein said pusher has two end edges and two side edges, said recesses being proximate the end edges.

5. The shelf assembly of claim 1 wherein at least one of said dividers has an L-shaped cross sectional configuration.

6. The shelf assembly of claim 1 further comprising extrusions containing silicone secured to a side edge of each of said horizontal portions of said pair of adjacent dividers to aid in enabling said pusher to move inside said track.

7. The shelf assembly of claim 1 wherein a plurality of said dividers have an inverted T shaped cross section.

8. The shelf assembly of claim 1 wherein said front frame member is located below said rear frame member such that said shelf assembly is declined.

9. The shelf assembly of claim 1 further comprising a sled located within said track.

10. The shelf assembly of claim 9 wherein said sled is adapted to support at least one of said products.

11. The shelf assembly of claim 10 wherein said sled is adapted to support said rearwardmost one of said products.

12. The shelf assembly of claim 11 wherein said pusher abuts against said rear frame member and said sled so as to urge said sled toward said front frame member.

13. The shelf assembly of claim 1 wherein said pusher is made of plastic.

14. The shelf assembly of claim 1 wherein said pusher is made of polyester.

15. The shelf assembly of claim 1 wherein said pusher has two T-sections each at a respective opposite end of said pusher, a portion of each of said T-sections being located below said supporting surfaces.

16. The shelf assembly of claim 1 further comprising a stopper located at a front end of said track for preventing said products from falling off said shelf assembly.

17. A shelf assembly comprising:

a shelf support;

a shelf having a front frame member, a rear frame member and a plurality of substantially parallel dividers extending between said front frame member and said rear frame member, an adjacent pair of said dividers each having an inverted T-shape in cross section and having a horizontal portion and a vertical portion, said horizontal portions of said pair of adjacent dividers defining generally planar supporting surfaces for supporting a plurality of products arranged in a column between said pair of adjacent dividers, said pair of adjacent dividers defining a track; and a pusher within said track for urging said column of products forwardly along said track, said pusher comprising a sheet of material having a memory property which causes said sheet to return to a planar orientation from a generally inverted U-shaped configuration, said pusher having recesses, the horizontal portions of said pair of adjacent dividers being located inside said recesses enabling said pusher to slide along said pair of adjacent dividers without becoming separated from said pair of adjacent dividers.

18. The shelf assembly of claim 17 further comprising a sled located inside said track for supporting one of said products.

19. The shelf assembly of claim 18 wherein said sled has guide members to hold the sled to said pair of adjacent dividers.

20. The shelf assembly of claim 17 wherein said recesses comprise four said recesses.

21. The shelf assembly of claim 17 wherein said pusher is adapted to assume said generally inverted U-shaped configuration above said supporting surfaces between said rear frame member and a rearwardmost one of said products.

22. The shelf assembly of claim 17 further comprising extrusions containing silicone secured to the horizontal portions of said pair of adjacent dividers for increasing an ability of said products and said pusher to move inside said track.

23. The shelf assembly of claim 17 wherein two outermost of said dividers have an L shaped cross section.

24. The shelf assembly of claim 17 wherein said pusher is made of polyethylene terephthalate.

25. The shelf assembly of claim 17 wherein said pusher has two T-sections each at a respective opposite end of said pusher, a portion of each of said T-sections being located below said supporting surfaces.

26. In combination a shelf and pushers, said shelf comprising a front frame member, a rear frame member, and a plurality of spaced parallel dividers extending between said front frame member and said rear frame member of said shelf, each of said dividers having a horizontal portion having at least one side edge and a vertical portion extending upwardly from said horizontal portion, some of said dividers having an inverted T-shape in cross section, said horizontal portions of said dividers defining generally planar supporting surfaces, each adjacent pair of said dividers defining a track, said shelf having multiple said tracks, each of said tracks adapted to support a plurality of products arranged in a column inside said track, each of said tracks having at least one of said pushers, each of said pushers having recesses which receive said side edges of said horizontal portions of a respective said pair of adjacent dividers, each of said pushers comprising a sheet having a memory characteristic which biases said sheet toward a flat planar orientation from an upwardly bowed, inverted U-shaped configuration, each of said pushers being forced into said upwardly bowed, inverted U-shaped configuration above said supporting surfaces when the products are disposed in said tracks.

27. The combination of claim 26 wherein each of said pushers has two side edges and, two end edges, said recesses of each of said pusher comprising four cutouts engaged which are with said side edges of said horizontal portions of said respective said pair of adjacent dividers.

28. The combination of claim 26 wherein said front frame member is below said rear frame member such that said shelf is downwardly sloping.

29. The combination of claim 26 further comprising a plurality of sleds each located in a respective one of said tracks.

30. The combination of claim 29 wherein each of said sleds is adapted to support at least one of said products.

31. The combination of claim 29 wherein each of said pushers abuts against said rear frame member and a respective one of said sleds to urge said respective one of said sleds toward said front frame member.

32. The combination of claim 29 wherein each of said sleds is made of wire.

33. A shelf assembly comprising:

a shelf having a pair of adjacent dividers defining a track adapted to support a plurality of products arranged in a column between said pair of adjacent dividers; and a pusher within said track for urging said column of products forwardly along said track, said pusher comprising a sheet of material having a memory characteristic, said pusher being adapted to assume an upwardly bowed inverted U-shaped configuration above horizontal portions of said pair of adjacent dividers between a rear frame member and a rearwardmost one of said products in said track upon receipt of said column of products such that said memory characteristic biases said sheet toward a flat planar orientation so as to urge said column of products forwardly, said pusher having a pair of T sections each disposed at a respective opposite end of said pusher, each of said T sections receiving said horizontal portions of said pair of adjacent dividers to retain and guide said pusher in said track.

34. The shelf assembly of claim 33 wherein each of said T section comprises recesses engaged with said horizontal portions of said pair of adjacent dividers.

35. A method of urgin a column of products forwardly in a shelf assembly, said shelf assembly comprising a shelf having a track defined by two adjacent dividers, each of said adjacent dividers having an inverted T-shape configuration in cross section and a horizontal portion and extending between a shelf front frame member and a shelf rear frame member, said horizontal portions of said adjacent dividers defining generally planar supporting surfaces, said method comprising:

providing a pusher comprising a flat planar sheet having multiple recesses, forcing said pusher into an upwardly bowed inverted U-shaped configuration above said supporting surfaces between a rearwardmost one of said products in said column and said shelf rear frame member such that a memory characteristic of said sheet causes said pusher to push said column of products forwardly in said track, said recesses of said pusher being engaged with said horizontal portions of said adjacent dividers so that said pusher will not separate from said horizontal portions of said adjacent dividers upon at least one of said products being removed from said track.

36. The method of claim 35 further comprising the step of placing one of said products in a sled, said pusher extending between said sled and said shelf rear frame member.

37. A shelf assembly comprising:

a shelf having substantially planar supporting surfaces and a plurality of substantially parallel spaced dividers extending from front to back on said shelf, some of said dividers having an inverted T-shape in cross section, an adjacent pair of said dividers and an adjacent pair of said substantially planar supporting surfaces defining a track for supporting a plurality of products arranged in a column between said pair of adjacent dividers; and a pusher for urging said column of products forwardly along said track, said pusher comprising a sheet of material having a memory characteristic which biases said sheet toward a flat planar orientation from an upwardly bowed inverted U-shaped configuration and a pair of T-sections each disposed at a respective opposite end of said pusher, a portion of each of said T-sections being located below said adjacent pair of supporting surfaces, said pusher being adapted to assume said upwardly bowed inverted U-shaped configuration above said supporting surfaces between a rearwardmost one of said products in said track and a rear portion of said shelf so as to urge said column of products forwardly.

38. The shelf assembly of claim 37 further comprising a sled slidably received inside said track and adapted to support at least one of said products.

39. The shelf assembly of claim 38 wherein said sled is made of wire.

* * * * *

UNITED STATES PATENT AND TRADEMARK OFFICE

CERTIFICATE OF CORRECTION

PATENT NO. : 6,015,051

DATED : January 18, 2000

INVENTOR(S) : Joseph M. Battaglia

It is certified that error appears in the above-identified patent and that said Letters Patent is hereby corrected as shown below:

Column 9, lines 24-25, "comprising four cutouts engaged which are with" should be --comprising four cutouts which are engaged with--.

Column 10, line 4, "urgin" should be --urging--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*